US005203630A

United States Patent [19]

Howk

[11] Patent Number: 5,203,630

[45] Date of Patent: Apr. 20, 1993

[54] SIDE ENTRY FLUID MIXING

[75] Inventor: Richard A. Howk, Rochester, N.Y.

[73] Assignee: General Signal Corp., Rochester, N.Y.

[21] Appl. No.: 832,144

[22] Filed: Feb. 6, 1992

[51] Int. Cl.[5] ..... B01F 7/06; B28C 5/08

[52] U.S. Cl. ..... 366/292; 366/103

[58] Field of Search ..... 366/66, 103, 104, 136, 366/137, 160, 292, 296, 297, 299, 300, 306, 325; 415/58.7; 416/231 A

[56] References Cited

U.S. PATENT DOCUMENTS

| | | | |
|---|---|---|---|
| 1,621,071 | 3/1927 | Kinkade | 366/160 |
| 2,116,099 | 5/1938 | Chamberlain | 366/325 |
| 2,854,223 | 9/1958 | Lee . | |
| 3,588,274 | 6/1971 | Norlindh | 366/296 |
| 3,770,251 | 11/1973 | Herfeld . | |
| 3,787,284 | 1/1974 | Richter | 366/292 |
| 4,325,642 | 4/1982 | Kratky | 366/137 |
| 4,468,130 | 8/1984 | Weetman . | |
| 4,606,648 | 8/1986 | Coyle | 366/297 |
| 5,118,199 | 6/1992 | Howk | 366/292 |

FOREIGN PATENT DOCUMENTS

| | | | |
|---|---|---|---|
| 3406648 | 9/1985 | Fed. Rep. of Germany | 366/300 |
| 1238675 | 6/1960 | France | 366/296 |

OTHER PUBLICATIONS

VQ Series Side-Entering Mixer Product Literature (1989).

*Primary Examiner*—Philip R. Coe
*Assistant Examiner*—Terrence R. Till
*Attorney, Agent, or Firm*—M. Lu Kacher; R. Hubbard

[57] ABSTRACT

In order to circulate a two-phase system (a suspension of solid particles in liquid) in a large (e.g., 100 ft. diameter) and shallow tank (e.g., where the liquid level, Z, to tank diameter, T, ratio is 0.4), a cluster of side entering mixers is used and a desired flow pattern (much like that obtained from a top entering mixer) along the bottom and top of the material in the tank and vertically along the walls of the tank is obtained by (a) rotating an end mixer in the cluster in opposite sense to the other mixers, (b) spacing the mixers so that the interference is reduced between the flow produced by the mixers at the wall of the tank opposite from the mixers, and (c) by tilting the mixers so that the flow intersects the bottom near the wall of the tanks opposite from the mixers. It is believed that the system geometry and direction of rotation of at least one end mixer in the cluster prevents the development of angular momentum of the material in the tank thereby avoiding swirling thereof and consequent asymmetrical, nonuniform flow patterns which are not optimum for particle suspension.

15 Claims, 3 Drawing Sheets

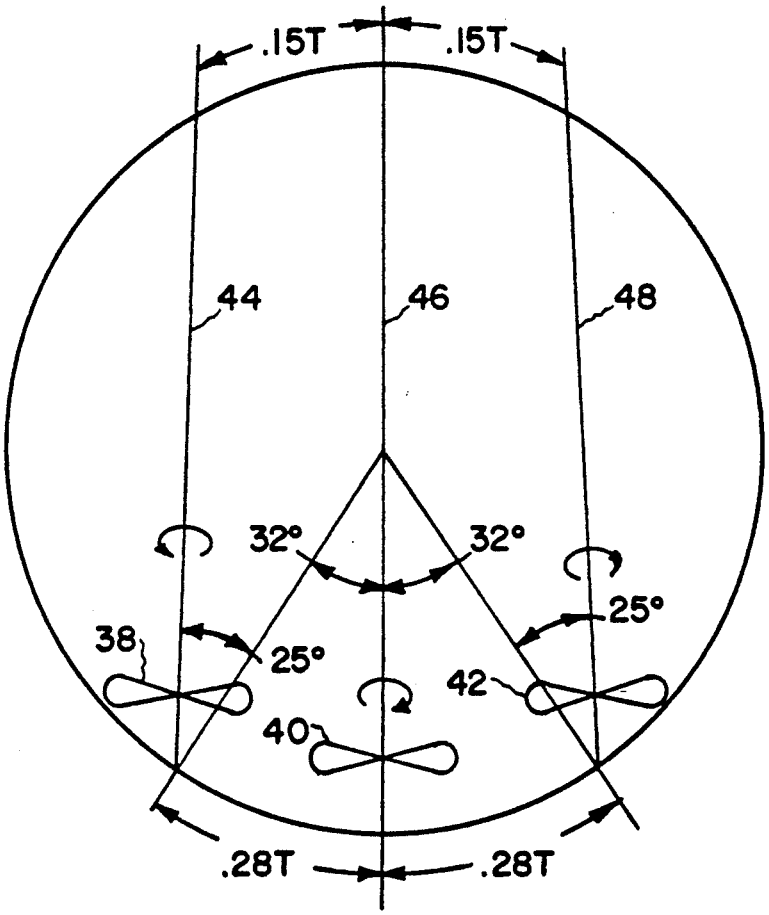
FIG. 3
FIG. 4
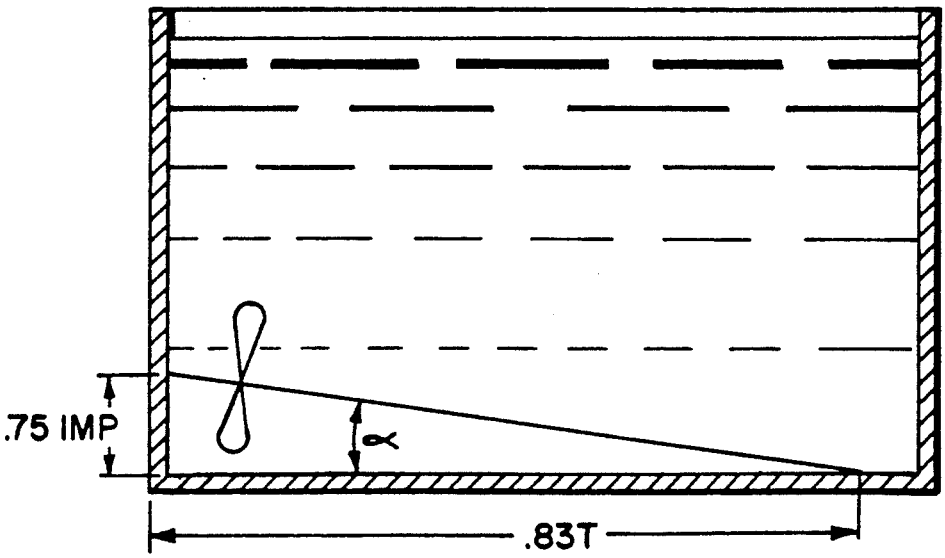

SIDE ENTRY FLUID MIXING

DESCRIPTION

The present invention relates to side entry fluid mixing and particularly to an improved system for suspending particles by mixing a two-phase suspension of the particles in a liquid medium in a tank having a cluster of side entering mixers.

The present invention is especially suitable for use in flue gas scrubbing applications where a limestone (calcium carbonate) water mixture is sprayed into flue gas as it ascends a chimney or stack so as to absorb sulfur dioxide in the gas and convert it into calcium sulfide which then converts into calcium sulfate (gypsum). The solid particles and water fall into a tank where the material (a slurry) is circulated so as to suspend the particles therein and facilitate the chemical reaction converting the calcium sulfide to calcium sulfate. The tank is large across the bottom thereof (for example, 100 ft. in diameter) and relatively shallow so that the liquid level is 60 percent or less than the tank diameter. It is a feature of this invention to provide a side entering mixer system which establishes a flow pattern in the tank which is optimal for suspending the particles in the liquid-particle (two-phase) suspension in that it provides circulation along the bottom and along the sides of the tank, rather than a swirling or tea cup like stirring action which is less optimum for particle suspension. Other applications for the side entering mixture system provided by the invention may be found, especially where large diameter, relatively shallow tanks are used.

Suspension of particles in a liquid-particle suspension or slurry is best carried out by using an axial flow impeller mixer which enters the tank containing the suspension from the top. Then a uniform flow pattern along the bottom of the tank and thence along the sides of the tank and returning downwardly to the impeller is obtained. There are applications, such as flue gas scrubbing, where it is not practicable to use top entering mixers. Then side entering mixer arrangements are used. It is difficult to establish, with side entering mixers, flow patterns such as are obtained with top entering mixers. Such flow patterns are especially desirable since they are symmetrical and avoid asymmetries or quiet zones where the particles can drop out of suspension and accumulate on the bottom or along the side walls of the tank. Such accumulation (called filleting) is undesirable because the accumulated material is not available to be pumped back out of tank, as to the spray nozzles for flue gas scrubbing. When fillets form near the inlets to the return pumps, clogging, which prevents proper operation of the scrubbing system, can result.

Side entering mixers have been used in a manner to cause swirling or tea cup like stirring action. In a typical installation three mixers are used 120 degrees apart around the wall of the tank. The axes of rotation of the mixers are tilted in the same direction away from radial lines to the center of the tank. Then the mixers cause swirling of the material in the tank around the periphery of the tank. Fillets can form in the center and in quiet zones in the vicinity of the mixers.

It has been suggested by the present inventor, Richard A. Howk, in his application Ser. No. 679,698 filed Apr. 3, 1991, now U.S. Pat. No. 5,118,199, issued Jun. 2, 1992, to use vanes in the discharge flow from side entering mixers so as to maintain the flow substantially axial, removing radial flow components which can cause failures in the mixers and their seals. It is desirable to avoid the use of such vanes since they may reduce flow by absorbing energy from the moving liquid and may be impractical in applications where the tank contains caustic or acidic solutions which can attack the material from which the vanes are constructed.

Accordingly, it is the principal object of the present invention to provide an improved side entering fluid mixing system.

It is another object of the invention to provide a improved system for suspending particles by mixing a two-phase suspension or slurry of particles in liquid in a tank with a cluster of side entering mixers.

It is a further object of the present invention to provide an improved side entering mixer system which establishes a circulating flow in a tank along the bottom thereof and then vertically along the side walls of the tank, which flow is in a uniform pattern, which sweeps the bottom of the tank and the side walls, and militates against the formation of fillets of particles in the tank.

It is a still further object of the present invention to provide an improved side entering mixer system for circulating two-phase suspensions in large, shallow tanks by circulating the suspension between opposite sides of the wall of the tank and along the bottom and top thereof rather than with a swirling flow around an axis at the center of the tank.

Briefly described, a mixing system embodying the invention circulates and suspends particles in a suspension having at least two phases. The suspension is in a tank having a bottom and a side wall. The wall has first and second regions which face each other and may be 180 degrees apart. The system establishes a circulating flow along the bottom upwardly along the side wall in the region opposite to the region from which the mixers project and then downwardly along the wall in the latter region. A cluster having a plurality of mixers enters the tank through the side wall. The mixers have shafts and impellers and are disposed along the side wall near the region thereof through which they enter. The impellers of the mixers are axial flow impellers and drive the suspension across the tank between the opposite wall regions. At least one of the mixers, which is at an end of the cluster, rotates in a direction opposite from the impellers of the other mixers in the cluster. The oppositely rotating impeller has its blades arranged to face in directions opposite to the blades of the other impellers so that all impellers pump and drive the liquid in the same direction. It has been found that the use of at least one impeller in the cluster which rotates in a direction opposite to the other militates against the development of angular momentum in the liquid which can set up a swirling or tea cup like stirring action. The flow is maintained across the bottom and then vertically along the sides of the tank, simulating the flow obtained with a top entering mixer. The flow field is symmetrical. This symmetrical field is enhanced by spacing the mixers so that their respective flow fields reach the opposite wall without interference. To this end, projections of the axis of rotation of the mixers on the opposite wall are desirably no less than a mixer diameter apart. Then interference is avoided which can give rise to asymmetrical flow patterns. In addition, radial components of the flow around the axis of the tank which may give rise to swirling are further reduced by tilting the axis of rotation of the mixers downwardly towards the bottom of the tank at a small angle, for example 5 degrees, between the projection of the axis and the bottom of the tank. The flow fields then intersect the bottom of the tank near the opposite wall region and the bottom acts as a baffle against the radial component of the flow.

The foregoing and other objects features advantages of the invention as well as presently preferred embodiments thereof will become more apparent from a reading of the following description in connection with the accompanying drawings in which:

FIG. 3 is a schematic, top view showing a preferred geometry of the mixer system illustrated in FIG. 1;

FIG. 4 is a view similar to FIG. 2 of the preferred geometry shown in FIG. 3;

Figure 6:
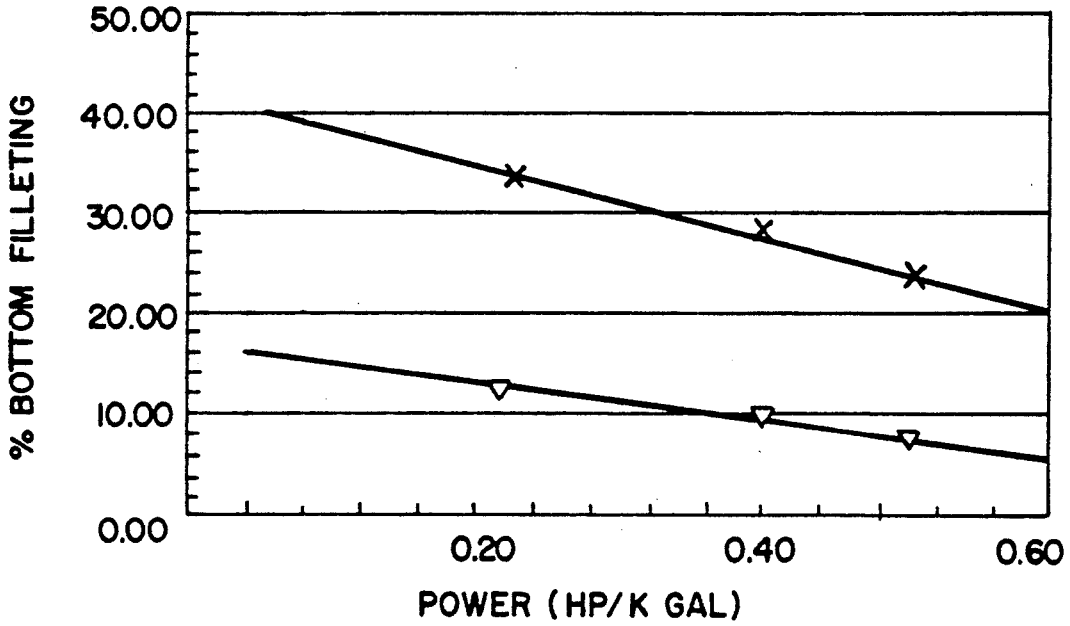

FIG. 6 are curves illustrating the solid particle depositions in a 48 inch diameter tank containing a 15 percent limestone (150 micron particle size or less) at different power levels and illustrating that the percentage of filleting at the bottom with a side entering mixer system in accordance with the invention (as illustrated by the curve through the triangles) is less than when the mixers all rotate in the same direction (as illustrated by the curve through the X's).

Figure 1:
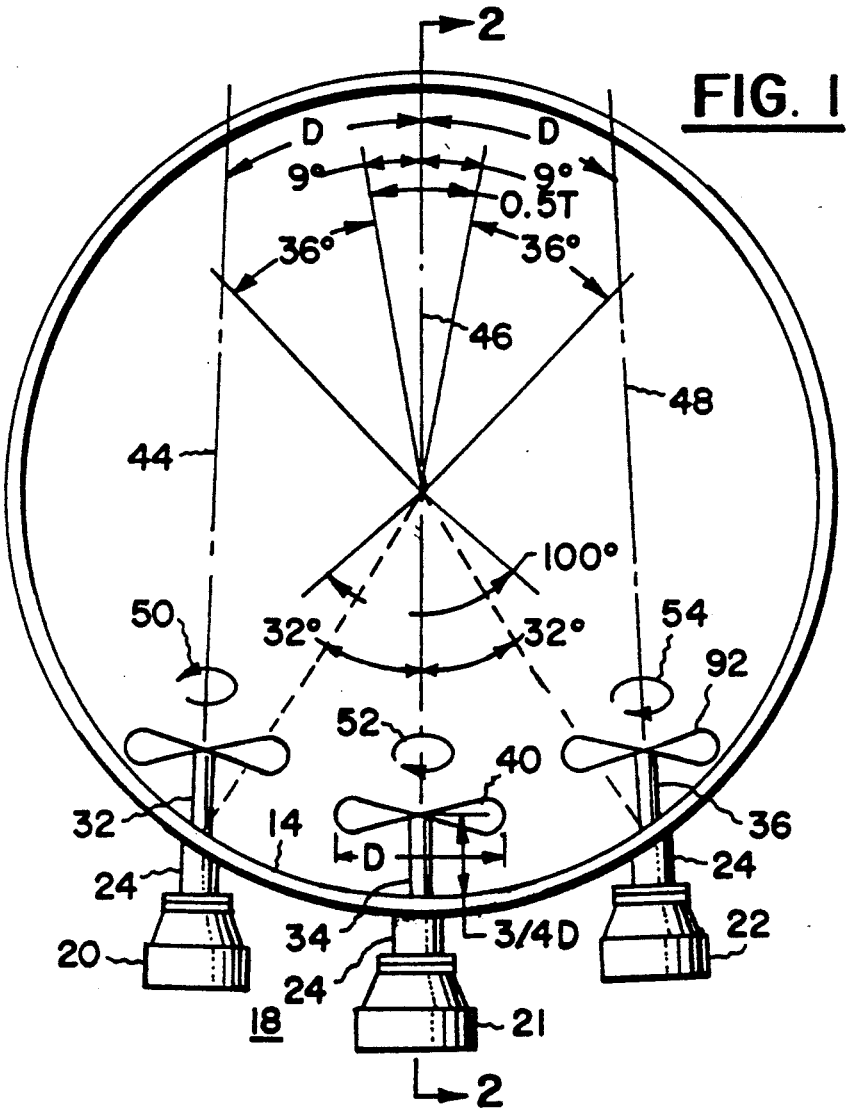
FIG. 1 is a plan view, schematically showing a side entering mixer system having a cluster of mixers in accordance with the invention.
Figure 2:
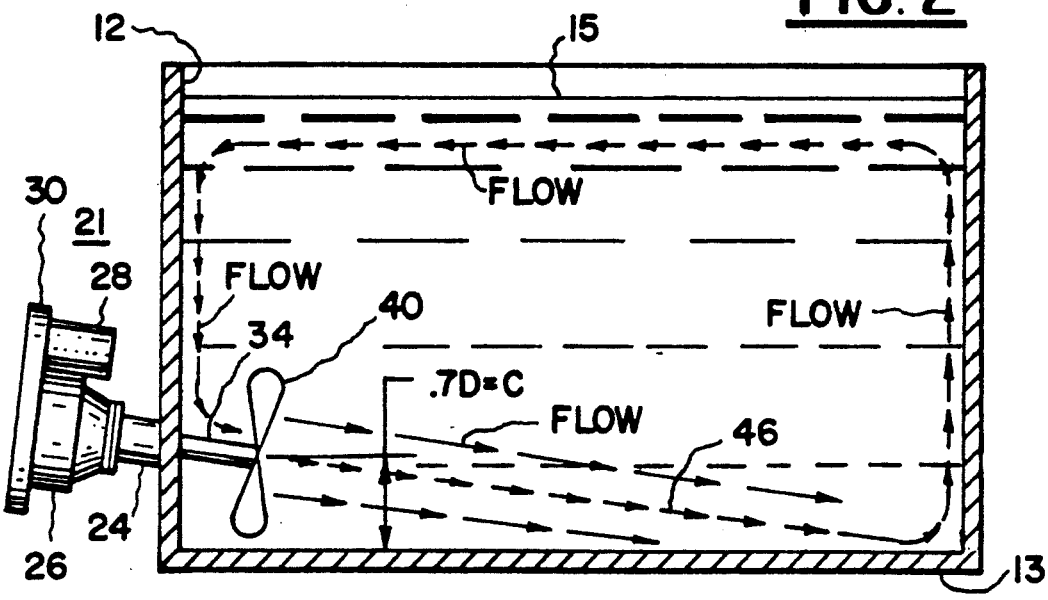
FIG. 2 is a sectional view of the mixer system shown in FIG. 1 taken along the line 2—2 and FIG. 1.

Referring to FIGS. 1 and 2, there is shown a tank 10 having a cylindrical side wall 12 with opposite regions 14 and 16 from one of which 14 a cluster 18 of three mixers 20, 21 and 22 extend. The mixers may be identical and have flanged nozzles 24 and housings 26 carrying motors 28. The housing includes a transmission 30, which is preferably a gear box type transmission but may be a belt transmission. The mixers have shafts 32, 34 and 36 on which are mounted axial flow impellers 38, 40 and 42. The impellers and their shafts have axes of rotation 44, 46 and 48. The impellers 38, 40 and 42 are cantilever mounted on their respective shafts 32, 34 and 36 and extend inwardly approximately 1.5 impeller diameters, D, into the tank from the wall region 14. The impellers are preferably type A-312 sold by Lightnin Mixers, a Unit of General Signal Corporation, Mt. Read Boulevard, Rochester, New York, USA. These impellers are similar to those shown in U.S. Pat. No. 4,468,130 issued Aug. 28, 1984 to R.J. Weetman, but the blades are somewhat wider than shown in the patent. The side entering mixers may be of the general type shown in the 1989 Bulletin entitled, VQ Series Side Entering Mixers, which was published by Lightnin Mixers of Mt. Read Boulevard, Rochester, New York, USA. It is desirable however that the mixers used in the illustrated system for the flue gas scrubbing application in a large diameter shallow tank have a gear drive. The illustrated tank is shown somewhat out of scale with respect to the mixers 20, 21 and 22. The diameter of the tank, T, may for example be approximately 100 feet. Then the ratio of impeller diameter D to the tank diameter T is approximately 0.07. This is in comparison to top entering mixers where D/T is from 0.3 to 0.4. Also the mixers 20, 21 and 22 are located so that their shafts are somewhat close to the bottom 13 of the tank 10 so as to ensure that the tank bottom is swept even when the liquid in the tank is being drained. Typically the liquid level, Z, as shown in 15 in FIG. 2 is relatively shallow, for example, Z/T may be approximately 0.6 to 0.4 or less (as the tank is being drained).

There are pumps (not shown) which enter the side walls of the tank and circulate the suspension therein back to the nozzles in the stack which spray the rising flue gas. Clogging of these inlets is avoided with the side entering mixer system provided by the invention because filleting is avoided.

The mixers 20, 21 and 22 of the cluster are arranged in approximately a quadrant of the tank which is indicated as being a sector of about 100 degrees in FIG. 1. The axes 44, 46 and 48 are spread apart and not focused at the center of the opposite region 16 where the axis 46 intersects the region 16. Rather the mixers are spread apart and tilted so that the flow therefrom do not have substantial overlap and does not substantially interfere (are in non-interfering relationship) although the axes are angled toward each other. This is carried out by insuring that the end mixers 20 and 22 have their axes in a zone or sector approximately 36 degrees along the opposite wall region 16 but spaced from the center by 9 degrees (outside the 18 degree zone or sector bisected by the axis of rotation 46). The zones or sectors may change depending upon D and T of the system.

In a preferred system the geometry is as shown in FIG. 3. Then the axes 44 and 48 intersect approximately in the center of the 36 degree zones or sectors.

In other words, FIGS. 1 and 3 show that the mixers 24 are spread apart so that their flows along the bottom of the tank do not substantially interfere, even though they converge. The axes of the impellers 38, 40 and 42 are tilted or angled toward the center of the tank. The cluster of impellers are in a 100° zone. The 100° is defined between radial lines from the center of the tank center. This zone is the region 14 (the first region of the opposite regions 14 and 16—the region 16 being the second region). The tilt or beta angles between the axes 44 and 48 and radial lines from the center of the tank to the intersections of the axes 44 and 48 and the side wall in the region 14 (which are 0.28T from the axis 46 of the center impeller 40) are shown as 25°. The second region is bisected by the axis 46 of the center impeller 40. There is an 18° sector, which separates 36° sectors in which extensions of the axes 44 and 48 of the end impellers 38 and 42 are incident on the side wall 10 in the second region 16.

It is found to be critical to the prevention of the development of angular momentum which gives rise to swirling circulation that at least one of the impellers at one end of the cluster 18 rotate in a direction opposite from the other impellers, while still pumping in the same direction across the tank from the region 14 to the region 16. The blades of the oppositely rotating impellers are of course mirror images so that they pump in the same direction while rotating in opposite directions. It is believed, without being limited to any particular theory of operation, that the counter rotating flow, as shown by the arrows 50, 52 and 54 in FIG. 1, precludes the establishment of the magnitude of angular momentum which gives rise to swirling circulation. In the system shown in FIGS. 1 and 2, all of the impellers are the same in design and all rotate at the same speed. The various speeds and diameters may be varied for different applications. In the flue gas application, the mixers are all desirably the same.

It has been found helpful, but not essential that the axes 44, 46 and 48 be tilted to make a small acute angle with the bottom 13 of the tank. Then the axes intersect close to the opposite region 16 as shown in FIG. 1. The angle, alpha in FIG. 4, is approximately 5 degrees and where C or the height of the axis above the bottom of the tank is 0.75D. The angle alpha is equal to the arc tangent of C/0.83T.

The mixing system shown in FIGS. 1 through 4 produces a flow indicated by the dash line labeled "FLOW" in FIG. 2. The flow, thus, sweeps the bottom 13 of the tank and also the side walls while circulating the suspension from the bottom to the top of the tank rather than swirling around the central axis of the tank.

Figure 5:
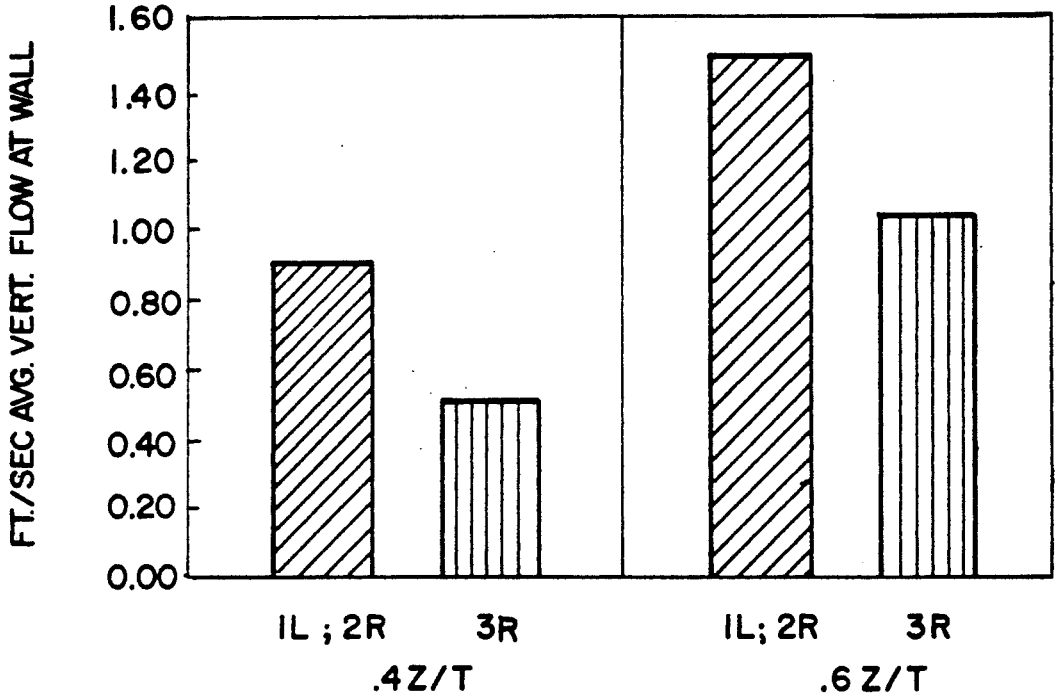
FIG. 5 is a bar chart of the average outlet flow along the wall of the tank opposite from the side entering mixers which illustrates the increase in flow obtained when one of the mixers at the end of the cluster rotates in a direction opposite to the other mixers.

FIG. 5 shows the average flow taken at points along the region 16 (where the flow travels upwardly as shown in FIG. 2). The curves are for tanks having Z/T ratios of 0.4 and 0.6 respectively. The hashed bars (1) are for the case where an end impeller rotates in a direction opposite to the other impellers of the cluster. The solid bar curves (2) are for the case where all of the mixers rotate in the same direction. It will be apparent that the vertical flow exceeds, in the case where one of the impellers in the cluster rotates in the opposite direction, the flow where all impellers rotate in the same direction.

FIG. 6 illustrates that the percentage of bottom filleting, that is the portion of the bottom 13 of the tank having fillets covering the bottom, is much reduced in the case of the curve shown by the line intersecting the triangles than in the case for the curve where the line intersects the X's. In the latter, all of the mixers rotate in the same direction and in the former, one of the mixers in the cluster rotates in a direction opposite from the others. This curve shows that there is a uniform flow field which sweeps the bottom of the tank with the improved mixing system provided by the invention.

From the foregoing description it will be apparent that there has been provided an improved side entering mixing system. Variations and modifications in the herein described system, within the scope of the invention, will undoubtedly suggest themselves to those skilled in the art. Accordingly, the foregoing description should be taken as illustrative and not in a limiting sense.

I claim:

1. A mixing system for circulating and suspending particles in a suspension having at least two phases in a tank having a bottom and a side wall about a center and having first and second interior regions which face each other, which system comprises a cluster comprising a plurality of mixers entering said tank through said side wall in said second region and disposed along said side wall in side-by-side relationship in a zone which subtends a sector of about 100° between radial lines to the center and are symmetrically disposed about a radial line to the center, a first and second of said plurality of mixers being disposed at opposite ends of said cluster and being separated by more than 60° defined between radial lines from said center to said side wall and said second region, said mixers having axial flow impellers and shafts which drive said suspension from said second to said first region, thereby establishing in the tank a circulating flow along the bottom, upwardly along the said wall and said first region and downwardly along said side wall in said second region, and said mixers being in spatial and orientational relationships such that the axes of said impellers do not intersect within the tank and said flow from each of said mixers is in substantially non-interfering relationship along the bottom of said tank between said first and second regions.

2. The system according to claim 1 wherein said tank has a length through said center equal to T, said impellers each has a diameter which does not exceed D; T being much greater than D, and at least one of said first and second mixers having the impeller thereof rotating in a direction opposite to the impellers of the plurality of mixers other than said one of said first and second mixers in said cluster.

3. The system according to claim 2 wherein D/T is less than 1.

4. The system according to claim 1 wherein said impellers of said mixers are spaced apart sufficiently that the flow therefrom along the bottom of the tank reaches said first region without diverging to an extent that the flow along the bottom of the tank from said mixers have substantial overlap with each other.

5. The system according to claim 4 wherein said cluster includes a third mixer between said first and second mixers, and wherein said tank wall is cylindrical and is of a diameter D, said center is the center thereof, the axes of said first and second mixer shafts when projected to said first region intersecting said first region at distances along said wall on opposite sides of the intersection of the axis of said third mixer shaft equal to about 0.15T, said axes of said first and second mixer shaft being angled with respect to the center of said tank by angles of at least about 25° defined between lines from the center of said tank to the intersections of said axes of said first and second mixers with the tank wall in said second region and said axes of aid first and second mixers, said axis of said third meter shaft when projected to said first region intersecting said center.

6. The system according to claim 4 wherein said cluster includes a third mixer between said first and second mixers, said tank having a center, said third mixer also having a shaft and an impeller and being rotatable in the same direction as the impeller of one of said first and second mixers, the shaft of said first and second mixers and the shaft of said third mixer having axes of rotation, the axes of rotation of said first, second and third mixers intersecting said wall in said first region at distances spaced from each other by at least the diameter of their respective impellers.

7. The system according to claim 6 wherein the axis of the shaft of said first and second mixers intersect said first region in sectors of about 36° spaced on opposite sides of a sector of about 18° which is bisected by the axis of the shaft of said third mixer, said sectors having their center at the center of said tank.

8. The system according to claim 6 wherein said tank is cylindrical, and of a diameter T, said cluster is disposed within a sector of about 100 degrees which subtends said second region.

9. The system according to claim 6 wherein the axes of the shafts of said mixers are spaced from the bottom of the tank, which is flat, by a distance equal to C and are in tilted relationship to the bottom of the tank over the entire area thereof by an angle such that said axes intersects said bottom at points less than 25% of the distance along the bottom away from said first region toward said second region.

10. The system according to claim 9 wherein said mixer impellers have blades which sweep diameters D and the axes of said shafts are spaced at a distance C vertically above the bottom of the tank where C is equal to about 0.7D.

11. The system according to claim 9 wherein said distance is T and said angle is approximately arctan C/0.83T.

12. The system according to claim 11 wherein said mixer impellers have blades which sweep diameters D and the axes of said shafts are spaced at a distance C vertically above the bottom of the tank where C is about 0.7D.

13. The system according to claim 1 wherein the shaft of said mixers have axes which are spaced from the bottom of the tank a distance equal to C and are in tilted relationship to the bottom of the tank over the entire area thereof by an angle such that said axes intersect said bottom at points less than 25% of the distance along said bottom between said first and second regions from said first region.

14. The system according to claim 13 wherein said angle is approximately arctan C/0.83T.

15. The system according to claim 1 wherein said mixer impellers have blades which sweep diameters D and the axes of said shafts are spaced at a distance C vertically above the bottom of the tank where C is about 0.7D.

* * * * *